US007513361B1

(12) United States Patent
Mills, Jr.

(10) Patent No.: US 7,513,361 B1
(45) Date of Patent: Apr. 7, 2009

(54) POWERED GROOMING UNIT

(76) Inventor: James Mills, Jr., 5327 107th Ave. North, Brooklyn Park, MN (US) 55443

( * ) Notice: Subject to any disclaimer, the term of this patent is extended or adjusted under 35 U.S.C. 154(b) by 201 days.

(21) Appl. No.: 11/724,691

(22) Filed: Mar. 16, 2007

(51) Int. Cl.
*B65D 69/00* (2006.01)

(52) U.S. Cl. ..... 206/234; 30/537; 132/315; 206/351; 206/373; 206/702

(58) Field of Classification Search ..... 206/37, 206/38, 234, 349, 351, 372, 373, 702, 722, 206/723, 725; 30/34.05, 210, 228, 537; 132/315; 312/902; 361/641, 643, 644; 439/501
See application file for complete search history.

(56) References Cited

U.S. PATENT DOCUMENTS 2,458,721 A * 1/1949 Nenno ..... 206/351
3,815,614 A * 6/1974 Waters et al. ..... 206/349
5,339,956 A * 8/1994 Thomason ..... 206/372
5,875,794 A * 3/1999 Ekman ..... 206/373
6,769,554 B1 * 8/2004 Udofiah ..... 211/70.6

* cited by examiner

*Primary Examiner*—Luan K Bui
(74) *Attorney, Agent, or Firm*—Richard John Bartz

(57) ABSTRACT

A self powering portable case has a custom liner insert tray accommodating electric hair clippers and trimmers and detachable blades therefore. Retractable power cords attached to the hair tools are dispensed from cord holders to facilitate tool use. The cords are electrically coupled to a power connector that is connected to a electric power supply to power the tools.

16 Claims, 7 Drawing Sheets

POWERED GROOMING UNIT

FIELD OF THE INVENTION

The invention relates to the field of portable kits for power grooming tools. In particular, the invention relates to kits for electric hair grooming clippers and accessory blades therefor.

BACKGROUND OF THE INVENTION

It is often difficult and bothersome to transport, handle, set up and use a plurality of electric hand tools, such as hair grooming clippers, having loose, easily tangled electrical cords and cables. Also, the power cord for each tool requires an electrical outlet to connect the tool to a power source. The area for tool use is limited to the length of the power cord. The tools are commonly placed on countertops, tables and/or work benches in haphazard and unorganized fashion.

SUMMARY OF THE INVENTION

The grooming unit of the invention is a portable self-powered multi-tool hair grooming kit. The kit is useable by barbers, hair care professionals and students to easily transport and set up hair grooming work stations at various locations.

The grooming unit has a case having a bottom wall joined to upright side walls defining an inner chamber. A cover hinged to the case closes the case. An insert member secured to the top of the case has one or more recesses accommodating hair grooming tools. A cord holder secured to the case is operable to hold the electric power cord attached to the grooming tool. The cord holder has a housing having a spool member rotatably mounted thereon that carries the power cord. Actuator means mounted on the housing is operable to control the rotation of the spool member. When the actuator means is actuated the spool member rotates to wind the power cord on the spool member. The cord can be pulled outwardly from the cord holder to dispense the cord from the spool member at a desired length during tool use.

DESCRIPTION OF PREFERRED EMBODIMENT

Figure 1:
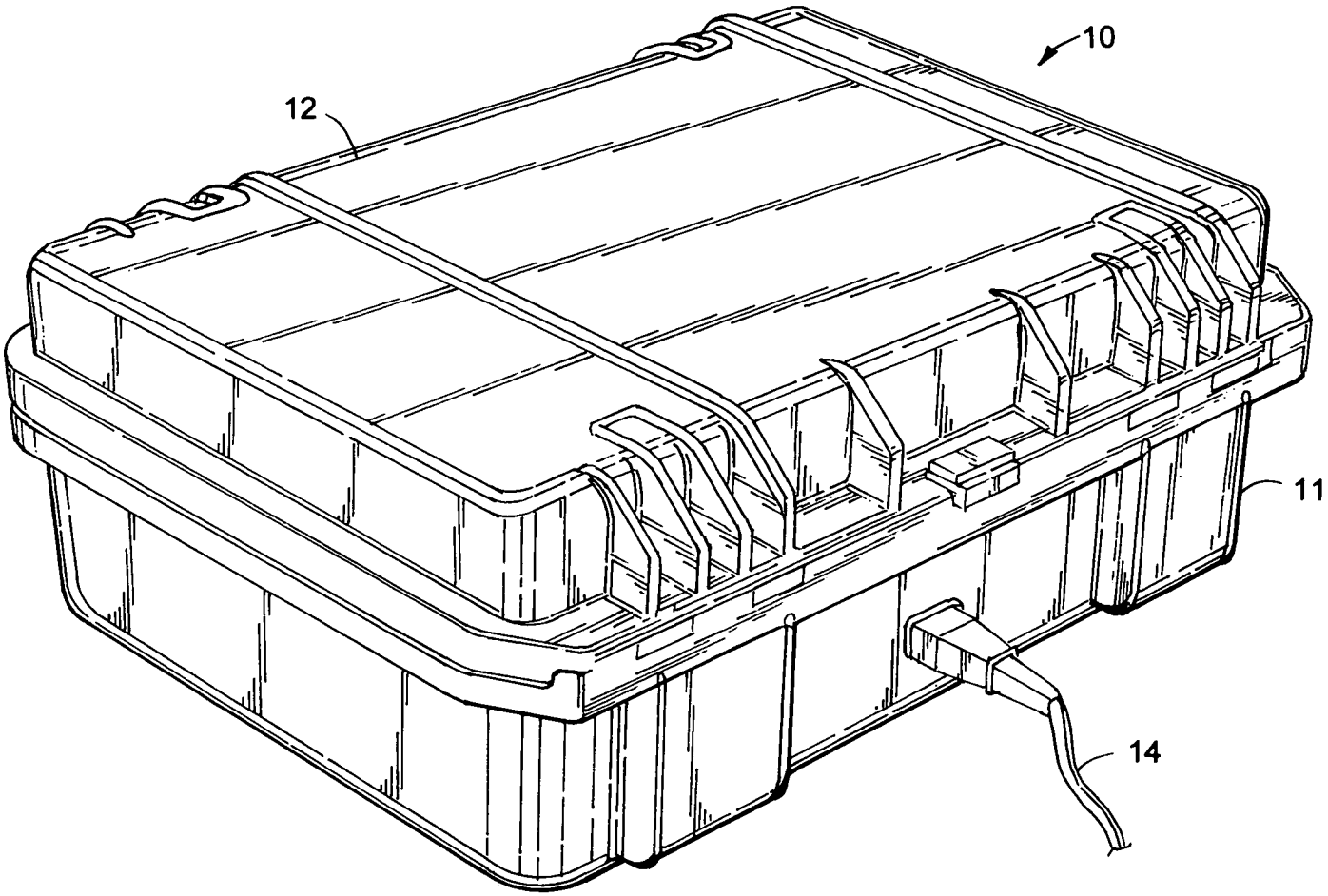
FIG. 1 is a rear perspective view of the portable grooming unit of the invention.

The portable grooming unit, indicated generally at 10 in FIGS. 1 to 6, has a plurality of hair grooming tools or clippers 26 operable to cut hair and trim mustaches, beards, goatees, neck hair, facial hair and the like. Clippers 26 are used with detachable blades 27 for various cuts of head, facial and neck hair. Unit 10 allows hair professionals, barbers and hair care students to transport and use clippers 26 and blades 27 in work areas, training areas and other locations quickly and easily in an organized, secure manner. Set up and break down of a grooming work area or training area is facilitated with the use of unit 10. Unit 10 can be adapted to be used with other hand held electrically powered grooming tools such as flat irons, curling irons, massagers, and hair dryers.

Unit 10 has a case 11 having upright side walls joined to a bottom wall with an open top. A cover 12 hinged to case 11 is operable to close case 11. Cover 12 has latches 16 engageable with plates 18 secured to the front of case 11 to hold cover 12 in a closed position on case 11. A handle 17 pivotally mounted on case 11 is used as a hand grip to facilitate transport of unit 10. Case 11 and cover 12 have overall dimensions that allow unit 10 to be easily transported from location to location by public or private transport.

Figure 2:
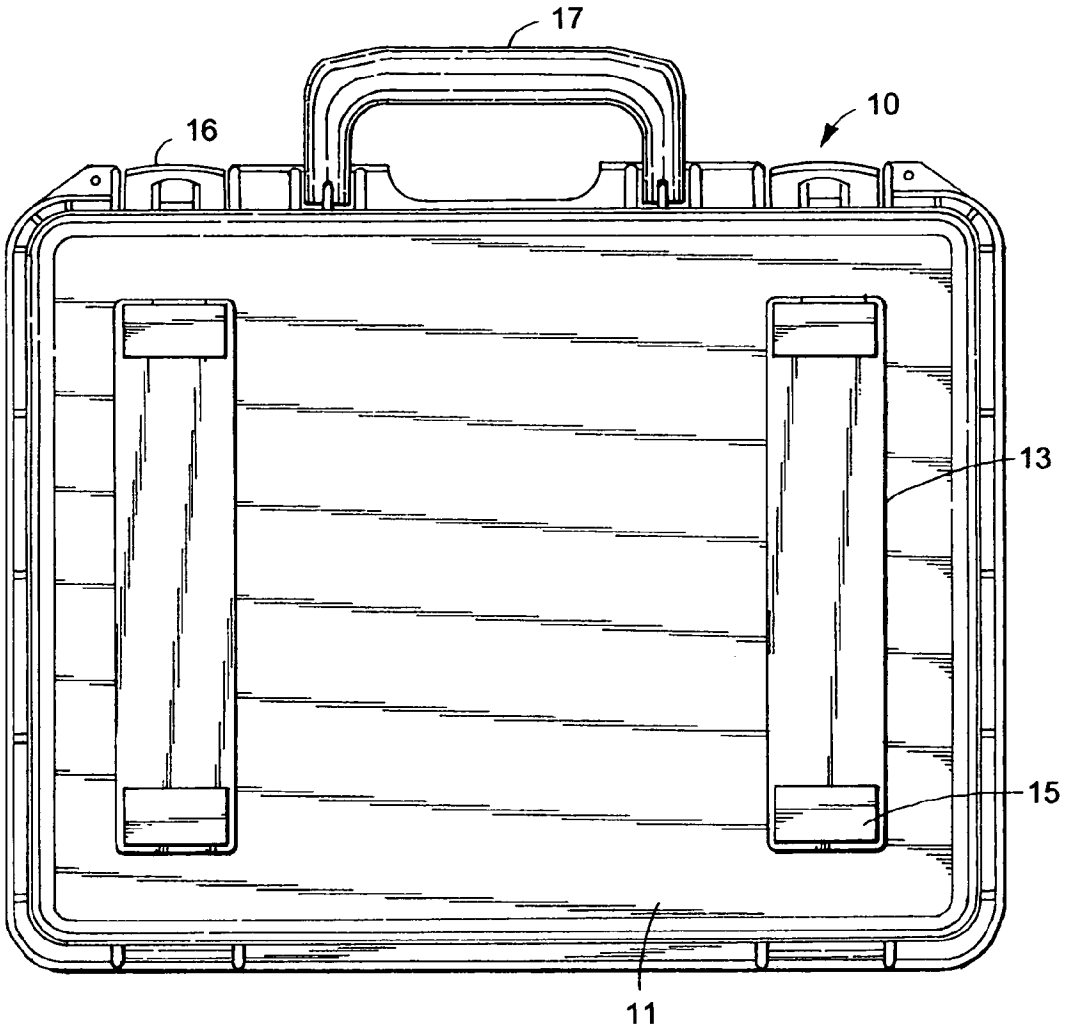
FIG. 2 is a bottom plan view of the grooming unit of FIG. 1.
Figure 3:
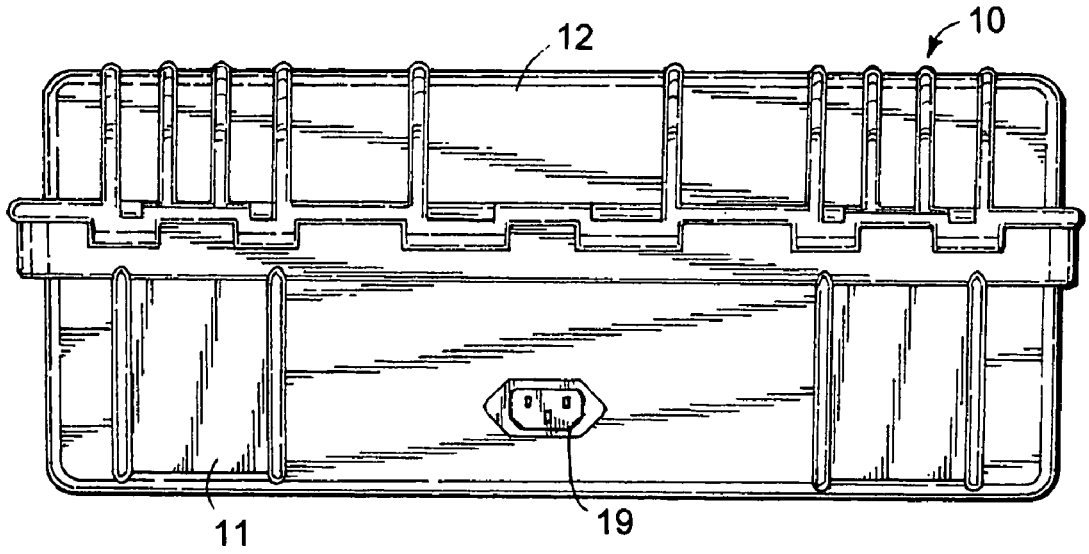
FIG. 3 is a rear elevational view of the grooming unit of FIG. 1.

As seen in FIG. 2, the bottom of case 11 has a pair of transversely extending rectangular feet 13 having downwardly extending pads 15 secured to the ends thereof. Pads 15 are operable to stabilize unit 10 when unit 10 is placed on a horizontal support surface, such as a countertop, sink top or work bench. A semi-flexible pad or cushion 29 secured to the inside of cover 12 engages tools 26 and blades 27 when cover 12 is closed. Cushion 29 prevents movements of tools 26 and blades 27 during transport and storage of unit 10.

Each tool 26 has an elongated electric power cord 28 to supply electric power to tool 26. Cords 28 are wound and stored on cord holders 31 secured to the bottom of case 11. Cords 28 can be pulled from cord holders 31 to dispense the desired length of cord 28 whereby tools 26 may be used to cut and trim hair at distances remote from case 11. When finished, cords 28 can be retracted back onto cord holders 31.

Referring to FIGS. 4 to 7, case 11 has an inner, generally rectangular open compartment 21 covered by a transverse insert or liner 22. Liner 22 is preferably a one-piece molded plastic member. Other materials can be used to make liner 22. Liner 22 has a plurality of side-by-side downwardly extending rectangular shaped recesses 23 and 25 that are adapted and shaped to accommodate tools 26. Each recess 23 and 25 is in general vertical alignment with one of cord holders 31 thereby preventing tangling of cords 28 attached to tools 26. A plurality of vertically aligned laterally spaced slots 24 located along one side of liner 22 adjacent recesses 23 accommodate blades 27. The bottom of each slot 24 is closed to hold the bottom of blade 27.

Figure 5:
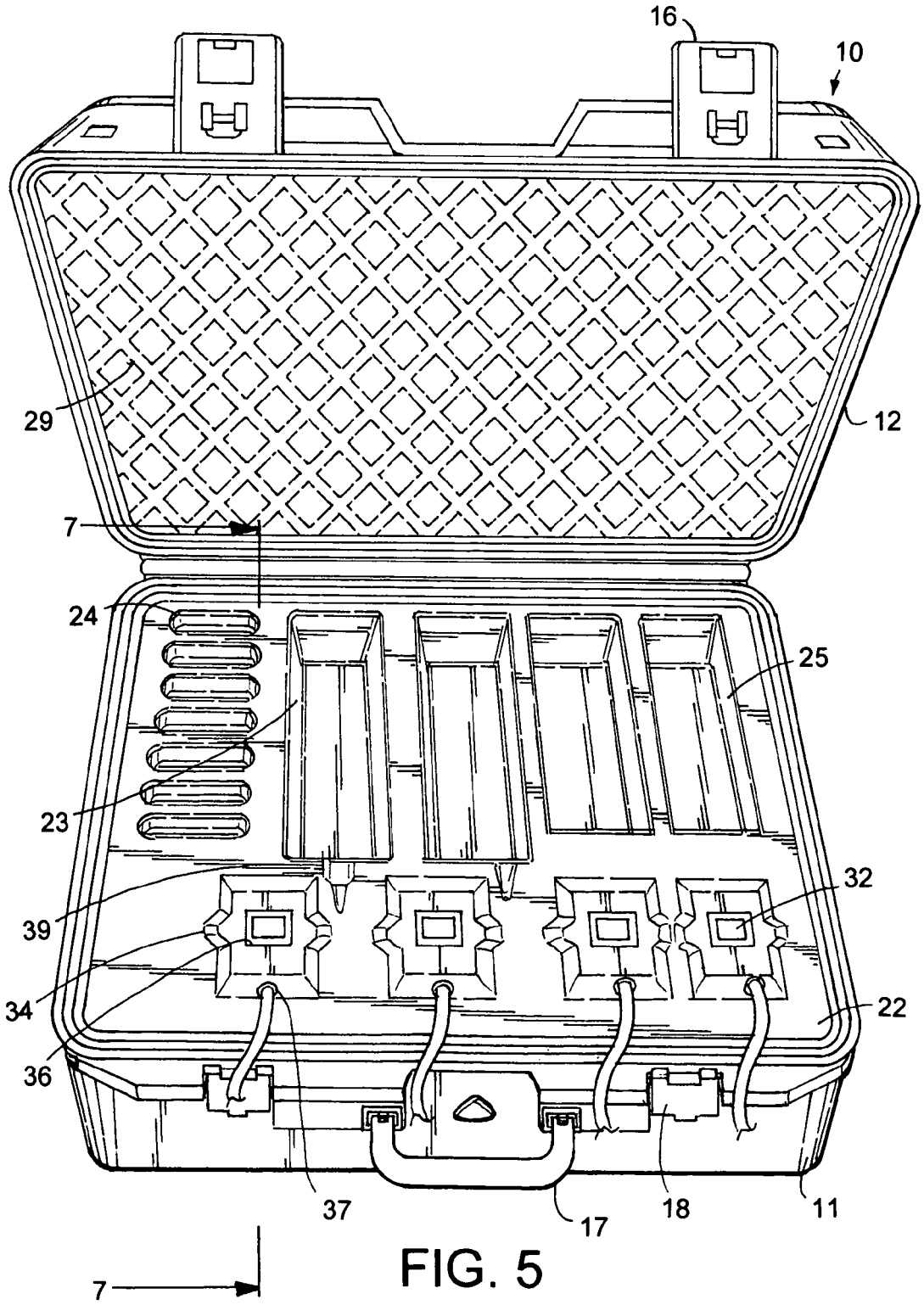
FIG. 5 is a front perspective view of the grooming unit of FIG. 1 with the cover opened and the clippers and blades removed from the tool tray liner.
Figure 6:
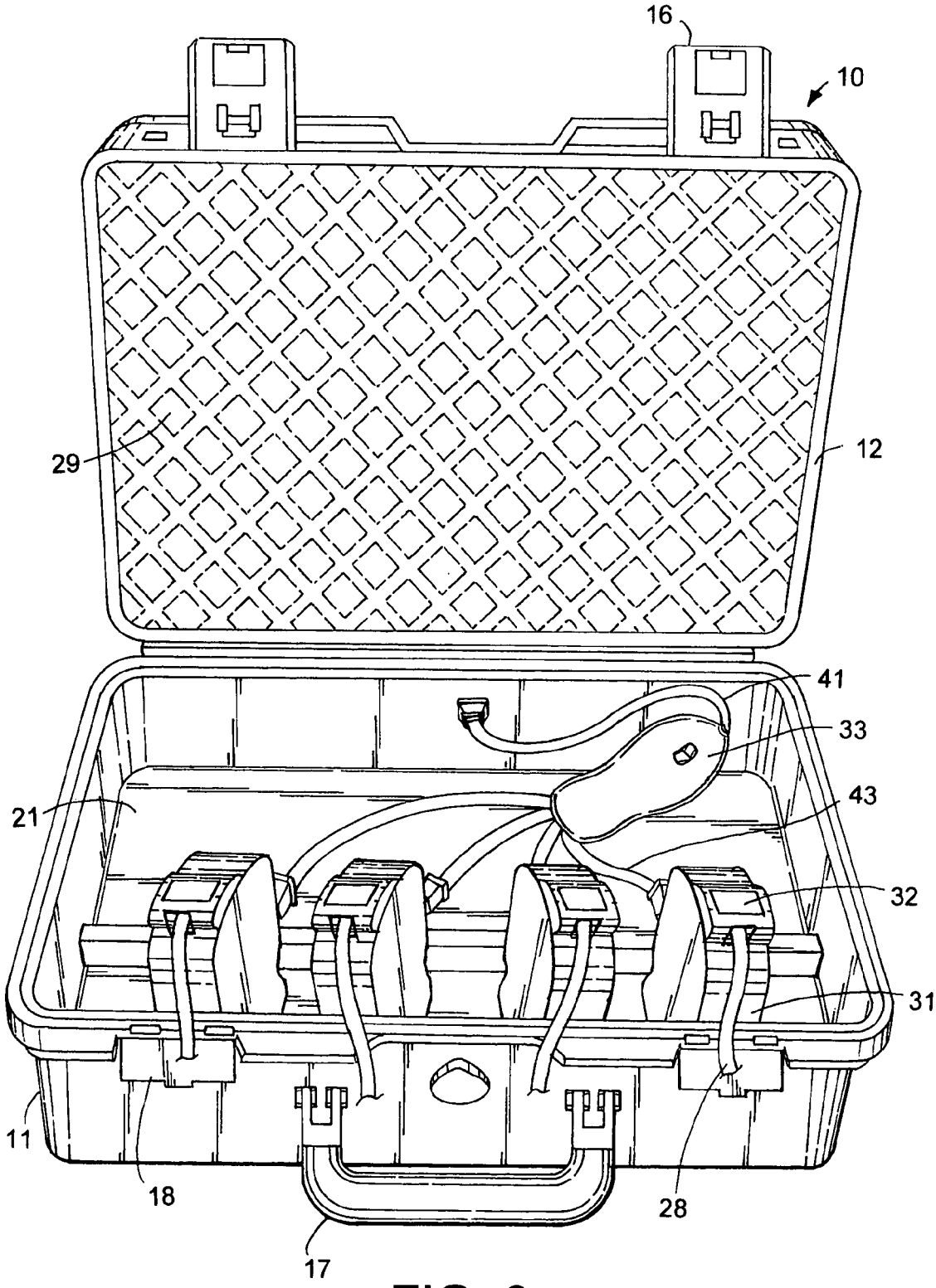
FIG. 6 is a top plan view of the grooming unit of FIG. 1 with the liner removed from the case.

Liner 22 has a plurality of raised cube shaped interior portions 34 that accommodate the tops of cord holders 31 located in compartment 21 below liner 22. Each raised portion 34 each has a rectangular shaped top opening 36 exposing an actuator button 32 mounted on cord holder 31. Tool power cord 28 extends through a generally circular side opening 37 in raised portion 34. A downwardly directed open slot 38 extending through raised portion 34 is in communication with side opening 37. Slot 38 guides cord 28 when cord 28 is dispensed from cord holder 31. As seen in FIG. 5, liner 22 has downwardly directed conical shaped recesses 39 adjacent the lower ends of recesses 23. Recesses 39 accommodate the lower ends of tools 26 when tools 26 are placed in recesses 23.

Figure 7:
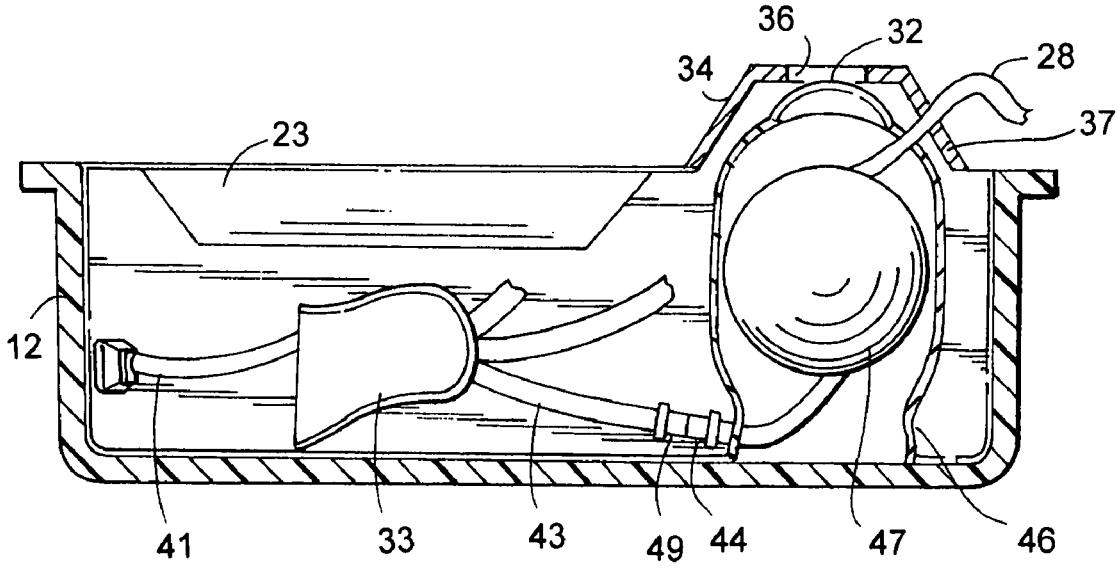
FIG. 7 is an enlarged sectional view taken along line 7-7 of FIG. 5.

As seen in FIG. 7, cord holder 31 has an upright housing 46. A spool 47 rotatably mounted on a housing 46. Cord 28 can be pulled outwardly to dispense a desired length of cord 28 from spool 47. Spool 47 is spring biased to automatically retract cord 28. A release button 32 operable connected to spool 47 allows spool 47 to rotate in a first direction so that cord 28 can be dispensed and pulled from spool 47 at a desired length for tension-free use over desired distances. Actuating button 32 causes spool 47 to rotate in the opposite direction thereby winding cord 28 on spool 47.

Cord connector 33 has a plurality of cords 43 extending from a centrally located body or hub 48. Each cord 43 has female plug receptacle 49 that accommodate a male plug 44 on the outer end of cord 28 extending from the bottom of cord holder housing 46. Connector 33 also protects against transient voltage surges directly into tool 26 that could damage tool 26. Connector 33 is electrically coupled with a power cord 41 to receptacle 19 on case 11. Power cord 14 located in receptacle 19 is plugged into a standard electric outlet to supply electric power to tools 26 through cord connector 33. Other types of power sources, such as batteries, can be used to power tools 26.

Figure 4:
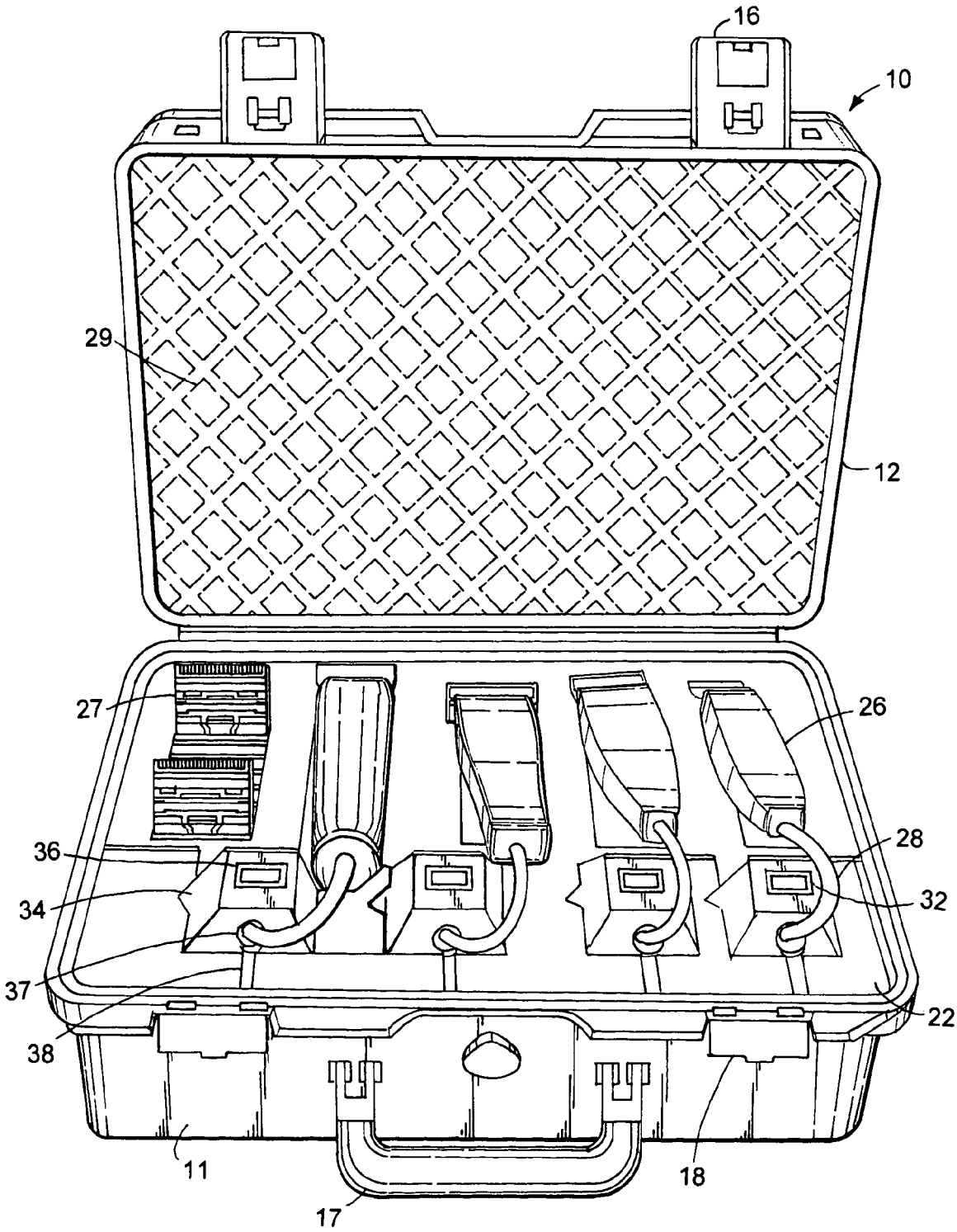
FIG. 4 is a front perspective view of the grooming unit of FIG. 1 with the cover opened.

In use, unit 10 is placed on a horizontal support surface, such as a countertop, whereby pads 15 engage the support surface to stabilize unit 10. Latches 16 are pulled from plates 16 so that cover 12 can be pivoted upwardly away from case 11 to an open position, as seen in FIG. 4. One end of power cord 14 is plugged into receptacle 19. The opposite end of power cord 14 is plugged into an electric outlet to supply electric power to tools 26 through cord connector 33 and connector cords 43 and tool power cords 28. A desired tool 26 is lifted out of liner recess 23, 25. Cord 28 is pulled outwardly from holder 31 until the desired length of cord 28 has been extended from housing 46. Button 32 allows cord 28 to be dispensed from holder 31 and prevents cord 28 from being retracted onto spool 47. When tool use is complete, tool 26 is placed in recess 23, 25. Button 32 is depressed and held down to auto-retract cord 28 back onto spool 47 in housing 46. Power cord 14 is unplugged from the electric outlet and receptacle 19 and can be placed inside of cover 12. Cover 12 is then moved to the closed position on case 11. Latches 16 are moved into engagement with plates 18 to hold cover 12 in the closed position.

There has been shown and described an embodiment of the portable grooming unit of the invention. Changes in the materials, structures, and arrangement of structures may be made by persons skilled in the art without departing from the invention.

The invention claimed is:

1. A hair grooming kit comprising: a case having a bottom wall joined to upright side walls defining an inner chamber, a cover closing the case, an insert member mounted on the case, the insert member having one or more recesses accommodating one or more hair grooming tools, each hair grooming tool having an electric power cord electrically coupled to an electric power supply, a cord holder secured to the case operable to hold the cord, the cord holder having a housing having a spool member rotatably mounted thereon, the spool member adapted to carry the cord, and actuator means mounted on the housing operable to control the rotation of the spool member whereby when the actuator means is actuated the spool member rotates to wind the cord on the spool member.

2. The kit of claim 1 wherein: the spool member is rotatable to allow the cord to be pulled outwardly from the cord holder at a desired length.

3. The kit of claim 1 wherein: the case has a receptacle connected to an electric power supply, the cord being electrically coupled to the receptacle.

4. The kit of claim 1 including: a cord connector connected to the cord, the cord connector operable to electrically connect the tool to the electric power supply.

5. The kit of claim 1 wherein: the insert member has one or more slots for accommodating blades detachable from the tool member.

6. The kit of claim 1 wherein: the insert member has a plurality of downwardly extending recesses accommodating the tool members, each recess located adjacent to a cord holder located below the insert member, the insert member having a first opening aligned with the actuator means and a second opening allowing the cord to wind onto and be dispensed from the spool member.

7. The kit of claim 6 wherein: the insert member has a raised portion accommodating a top portion of the cord holder, the first and second openings extending through the raised portion.

8. The kit of claim 1 wherein: the power cord of each tool member is electrically connected to a cord connector, the cord connector operable to electrically connect the tools to an electric power supply.

9. The kit of claim 8 wherein: the cord connector has means preventing voltage surges directly into the tools.

10. A portable case for one or more electrically powered hand tools comprising: a top member, a bottom member attached to upright side walls defining an inner compartment, a transverse member attached to the side walls closing the compartment, the transverse member having recess means for accommodating at least one tool attached to an electric power cord, holder means located within the compartment for holding the cord, the holder means including winding means for retracting the cord into the holder means, actuator means mounted on the holder means operable to control the winding means whereby when the actuator means is actuated the winding means retracts the cord into the holder means, the winding means allowing the cord to be dispensed from the holder means at a desired length, the actuator means operable to hold the cord dispensed from the holder means at the desired length without tension.

11. The case of claim 10 wherein: one of the side walls has a receptacle connected to an electric power supply, the cord being electrically coupled to the receptacle.

12. The case of claim 10 including: connector means connected to the cord, the connector means operable to electrically connect the tool to an electric power supply.

13. The case of claim 12 wherein: the connector means is connected to a plurality of electric power cords attached to one or more tools.

14. The case of claim 12 wherein: the connector means includes means preventing voltage surges directly into the tool.

15. The case of claim 10 wherein: the transverse member has a first opening aligned with the actuator means and a second opening allowing the cord to retract into and be dispensed from the holder means.

16. The case of claim 15 wherein: the transverse member has an interior portion accommodating a portion of the holder means, the first and second openings extending through the interior portion.

* * * * *